US008250777B2

(12) United States Patent
Kim et al.

(10) Patent No.: US 8,250,777 B2
(45) Date of Patent: Aug. 28, 2012

(54) DEVICE OF SUPPLYING WATER FOR LAUNDRY DRYER AND METHOD FOR CONTROLLING THE SAME

(75) Inventors: Young Soo Kim, Changwon-si (KR); Dae Bong Yang, Jinhae-si (KR); Chul Jin Choi, Changwon-si (KR); Jung Yoo, Busan (KR); Jae Hyuk Wi, Busan (KR)

(73) Assignee: LG Electronics Inc., Seoul (KR)

( * ) Notice: Subject to any disclaimer, the term of this patent is extended or adjusted under 35 U.S.C. 154(b) by 494 days.

(21) Appl. No.: 11/919,437

(22) PCT Filed: Nov. 7, 2006

(86) PCT No.: PCT/KR2006/004642

§ 371 (c)(1),
(2), (4) Date: Nov. 23, 2009

(87) PCT Pub. No.: WO2008/056836

PCT Pub. Date: May 15, 2008

(65) Prior Publication Data

US 2010/0058610 A1 Mar. 11, 2010

(51) Int. Cl.
*F26B 21/06* (2006.01)

(52) U.S. Cl. ..... 34/595; 34/601; 34/603; 34/610; 68/19; 68/142

(58) Field of Classification Search ..... 34/595, 34/601, 602, 603, 606, 610, 60, 80; 68/19, 68/142

See application file for complete search history.

(56) References Cited

U.S. PATENT DOCUMENTS

| | | | | |
|---|---|---|---|---|
| 4,103,433 | A * | 8/1978 | Taylor | 34/86 |
| 4,250,628 | A * | 2/1981 | Smith et al. | 34/260 |
| 5,983,520 | A * | 11/1999 | Kim et al. | 34/261 |
| 7,235,109 | B2 * | 6/2007 | Kleker | 8/149.3 |
| 2003/0061843 | A1 * | 4/2003 | Ryu et al. | 68/17 R |
| 2004/0103697 | A1 | 6/2004 | Kim et al. | |
| 2004/0168481 | A1 * | 9/2004 | Usherovich et al. | 68/13 R |
| 2004/0250442 | A1 * | 12/2004 | Ryu | 34/140 |
| 2006/0201209 | A1 | 9/2006 | Lee et al. | |
| 2010/0058610 | A1 * | 3/2010 | Kim et al. | 34/474 |

FOREIGN PATENT DOCUMENTS

| | | |
|---|---|---|
| CA | 1082477 | 7/1980 |
| DE | 2650190 | 8/1977 |
| DE | 34 08 136 | 9/1985 |
| EP | 0155340 | 9/1985 |
| EP | 1 029 961 | 2/2005 |

(Continued)

*Primary Examiner* — Stephen M. Gravini
(74) *Attorney, Agent, or Firm* — McKenna Long & Aldridge LLP

(57) ABSTRACT

A water supply device for a drying machine and a method for controlling the same are disclosed. The water supply device includes a common hose having one end connected to at least one water supply source, a drying machine water supply hose having one end connected to the common hose and the other end connected to a steam generator of the drying machine, and a washing machine water supply hose having one end connected to the common hose and the other end connected to a washing machine. With the provision of the water supply device, the drying machine has the effects of preventing wrinkles, creases, or the like from being generated in an object to be dried, such as clothes, and the like, or eliminating wrinkles, creases, or the like in clothes, and the like.

6 Claims, 4 Drawing Sheets

FOREIGN PATENT DOCUMENTS

| | | | | |
|---|---|---|---|---|
| EP | 1 550 760 | | | 7/2005 |
| EP | 1 555 340 | | | 7/2005 |
| GB | 1015421 | | | 12/1965 |
| GB | 2044297 | A | * | 10/1980 |
| JP | 2004000537 | A | * | 1/2004 |
| KR | 10-2002-0069593 | | | 9/2002 |
| RU | 2264488 | C2 | | 3/2005 |
| SU | 986992 | | | 1/1983 |

* cited by examiner

DEVICE OF SUPPLYING WATER FOR LAUNDRY DRYER AND METHOD FOR CONTROLLING THE SAME

This application claims the benefit of PCT/KR2006/004642, filed on Nov. 7, 2006, the contents of which is hereby incorporated herein by reference in its entirety.

TECHNICAL FIELD

The present invention relates to a water supply device for a drying machine and a method for controlling the same, and more particularly, to a water supply device for use in a drying machine for preventing a drying object, such as clothes, and the like, from being wrinkled or creased, or eliminating wrinkles or creases generated in the drying object.

BACKGROUND ART

A drying machine is a home appliance for drying an object to be dried, such as completely washed laundry, by use of high-temperature air. Generally, the drying machine includes a drum for receiving an object to be dried, a drive unit for driving the drum, a heating unit for heating air to be introduced into the drum, a blower unit for suctioning air inside the drum or discharging the air out of the drum, and the like.

Drying machines may be classified, on the basis of an air heating manner, that is to say, on the basis of heating means, into an electric drying machine and a gas drying machine. The electric drying machine is adapted to heat air by use of electric resistance heat, and the gas drying machine is adapted to heat air by use of heat generated via burning of gas. With another classification manner, drying machines also may be classified into a condensing-type drying machine and an exhausting-type drying machine. In the condensing-type drying machine, if humid air is generated from a drum via heat exchange with an object to be dried, the humid air is circulated within the drying machine rather than being discharged out of the drying machine. In this case, the air is again heat exchanged with outside air in a condenser, and the resulting condensate water is discharged to the outside. On the other hand, in the exhausting-type drying machine, the humid air, which was heat exchanged with an object to be dried within the drum, is directly discharged out of the drying machine. With yet another classification manner, drying machines may be classified, on the basis of a manner of inputting an object to be dried into the drying machine, into a top loading drying machine and a front loading drying machine. The top loading drying machine is designed to input the drying object through a top side thereof, while the front loading drying machine is designed to input the drying object through a front side thereof.

The above described conventional drying machines, however, have the following problem.

Generally, into a drying machine is inputted laundry, which has been completely washed and dehydrated, so as to be dried in the drying machine. Due to the principle of washing, however, the completely washed laundry inevitably has creases, and the generated creases have a difficulty to be completely eliminated in a drying course that is performed in the drying machine. Accordingly, the conventional drying machines have a disadvantage in that additional ironing is necessary to eliminate creases in an object, such as laundry, which has been completely dried in the drying machine. Also, in addition to the completely washed laundry, clothes, etc. are not free from wrinkles, creases, folds, and the like (hereinafter, generally referred to as "creases") when they are generally stored in chests or worn by wearers. Accordingly, there exists a requirement for a device capable of expediently eliminating creases that are generated in clothes, etc. stored in chests or worn by wearers.

DISCLOSURE

Technical Problem

An object of the present invention devised to solve the problem lies on a water supply device for a drying machine which is capable of preventing a completely dried object from suffering from creases, and a method for controlling the same.

Another object of the present invention devised to solve the problem lies on a water supply device for a drying machine which is capable of eliminating creases generated in clothes, etc. without using an iron, and the like.

Technical Solution

The object of the present invention can be achieved by providing a water supply device for a drying machine comprising: a common hose having one end connected to at least one water supply source; a drying machine water supply hose having one end connected to the common hose and the other end connected to a steam generator of the drying machine; and a washing machine water supply hose having one end connected to the common hose and the other end connected to a washing machine.

Preferably, at least one of the drying machine water supply hose and the washing machine water supply hose is provided with a valve capable of selectively intercepting a flow path.

Preferably, the valve is a drying machine valve and adapted to be automatically opened and closed on the basis of the amount of water filled in the steam generator. In this case, preferably, the steam generator has a water level sensor so that the drying machine valve is automatically opened and closed on the basis of the level of the water filled in the steam generator if the water level sensor senses the level of the water.

In another aspect of the present invention, provided herein is a method for controlling a drying machine comprising: connecting at least one water supply source to a washing machine and a steam generator of a drying machine; and supplying water from the water supply source into at least one of the washing machine and the steam generator of the drying machine.

Preferably, in the step of supplying water, the supply of water into the steam generator of the drying machine is automatically controlled on the basis of the amount of water filled in the steam generator.

With the above described present invention, it is possible to efficiently prevent a completely dried object from being creased and to efficiently eliminate creases generated in the object.

The effects of the drying machine and the control method for the same according to the present invention are as follows.

Firstly, the present invention has the effect of efficiently preventing a completely dried object from being wrinkled or creased, or eliminating wrinkles or creases generated in the object. According to the present invention, such an efficient elimination of the wrinkles or creases can be accomplished without using an iron.

Secondly, the present invention has the effect of supplying an appropriate amount of water into the drying machine through the use of the water supply device for the drying machine without any inconvenience to users.

Advantageous Effects

Water supply device for drying machine according to the present invention structured as above has the following effects.

Firstly, the present invention has an advantage in that it is possible to efficiently prevent a completely dried object from being creased, or to remove creases in the object. Also, the present invention has an advantage in that it is possible to efficiently remove creases or wrinkles in dried clothes without an ironing operation.

Secondly, with a water supply device for the drying machine, there is an advantage in that an appropriate amount of water can be supplied into the drying machine without causing the user's inconvenience.

DESCRIPTION OF DRAWINGS

The accompanying drawings, which are included to provide a further understanding of the invention, illustrate embodiments of the invention and together with the description serve to explain the principle of the invention.

In the drawings.

BEST MODE

Reference will now be made in detail to the preferred embodiments of the present invention, examples of which are illustrated in the accompanying drawings.

Hereinafter, a drying machine and a method for controlling the same according to the present invention will be described, for the sake of explanation, with reference to an embodiment related to an electric condensing-type drying machine employing a top loading type laundry input manner. However, it will be appreciated by those skilled in the art that the present invention is not limited thereto and may be applied to an gas condensing-type drying machine employing a front loading type laundry input manner, and so on.

Figure 1:
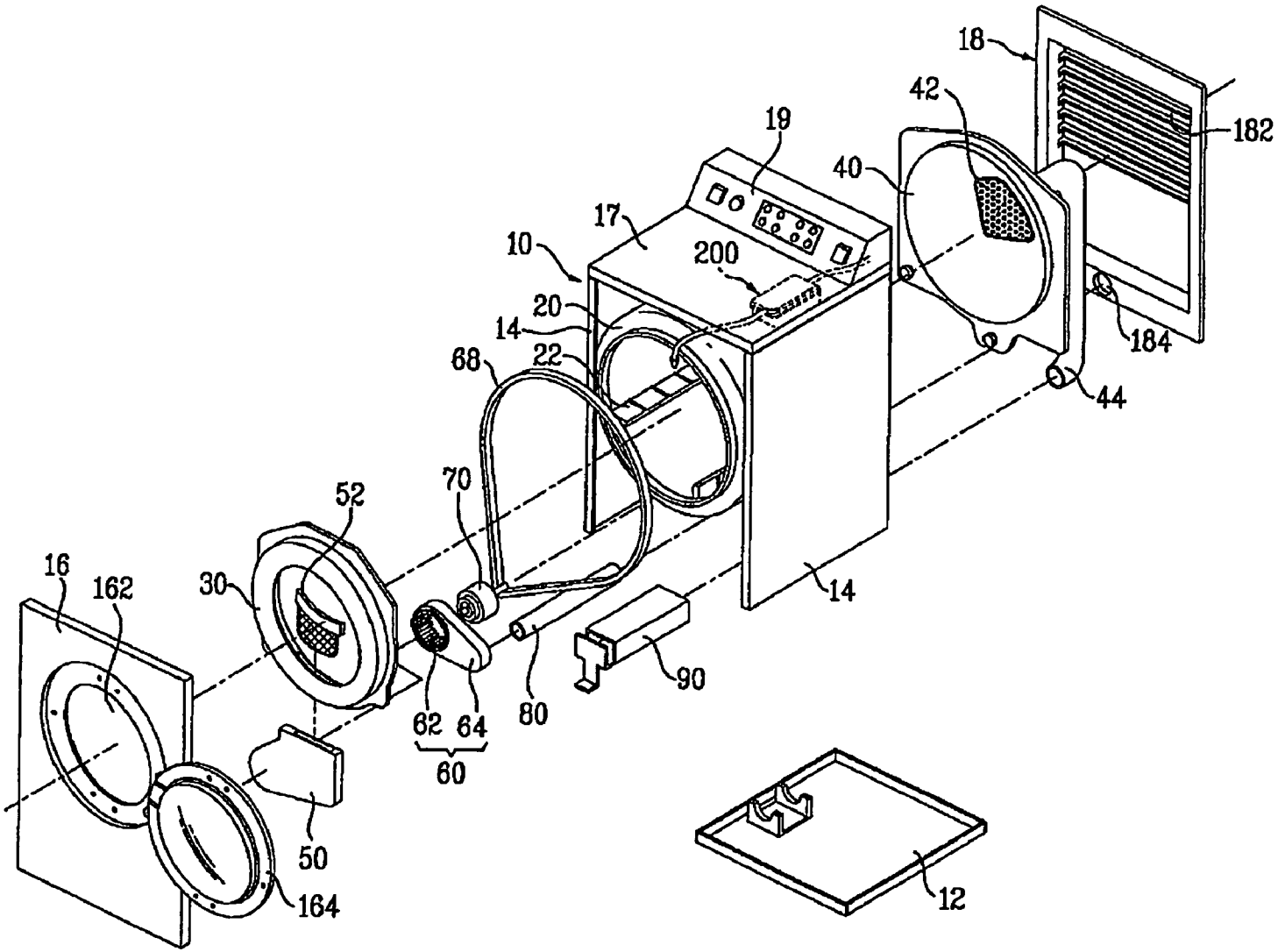
FIG. 1 is an exploded perspective view illustrating a drying machine according to the present invention.
Figure 2:
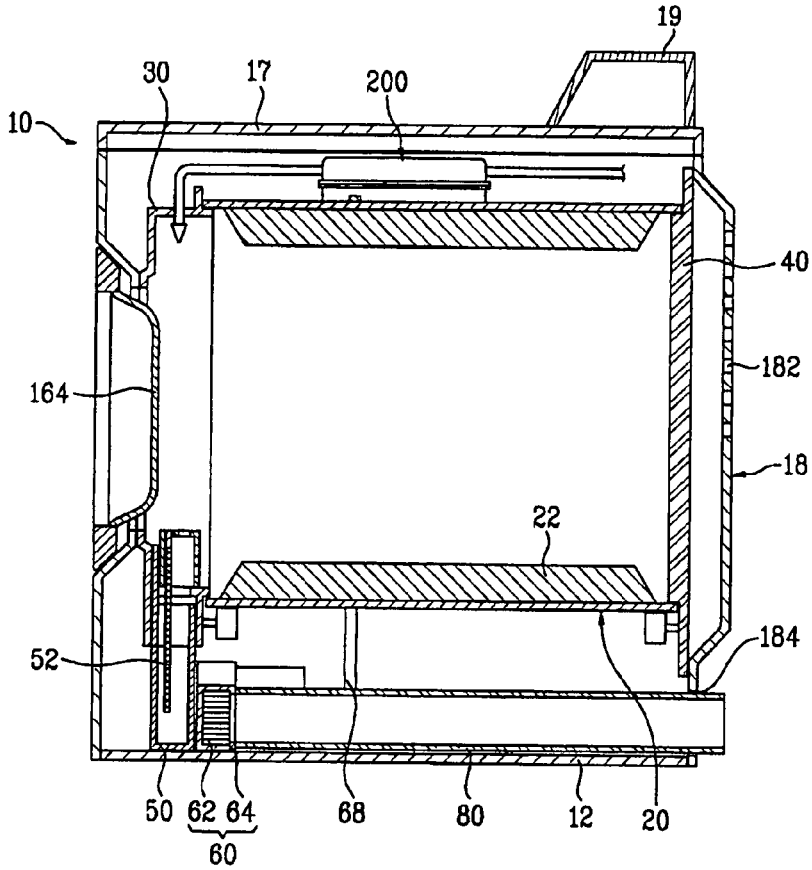
FIG. 2 is a longitudinal sectional view of FIG. 1.

Referring to FIGS. 1 and 2, a drying machine and a method for controlling the same according to a preferred embodiment of the present invention will be described.

The drying machine comprises a cabinet 10 defining the outer appearance of the drying machine, a rotatable drum 20 installed in the cabinet 10, and a motor 70 and a belt 68 installed in the cabinet 10 for driving the drum 20. A heater 90 is also installed within the cabinet 10 at a predetermined position and adapted to generate high-temperature air (hereinafter, referred to as "hot air") by heating air. Hereinafter, for the sake of explanation, the heater 90 is referred to as "hot air heater". To supply the hot air generated from the hot air heater 90 into the drum 20, a hot air supply duct 44 is installed. Also, there are installed an exhaust duct 80 for discharging humid air that was heat exchanged with a wet object received in the drum 20, a blower unit 60 for suctioning the humid air, and so on. Meanwhile, the cabinet 10 incorporates, at a predetermined interior position thereof, a steam generator 200 for generating high-temperature steam. In the present embodiment, an indirect drive type drying machine, in which the drum 20 is rotated by the motor 70 and the belt 68, is illustrated and described for the sake of explanation, but the present invention is not limited thereto. That is to say, it will be appreciated by those skilled in the art that the present invention may be applied to a direct drive type drying machine in which a motor is directly connected to a rear surface of the drum 20 so as to rotate the drum 20.

Now, the above mentioned constituent elements will be described in detail, respectively.

The cabinet 10, which defines the outer appearance of the drying machine, includes a base 12 defining a bottom wall, a pair of side covers 14 mounted on the base 12 perpendicular thereto, a front cover 16 and a rear cover 18 mounted at front and rear sides of the side covers 14, respectively, and a top cover 17 located on a top of the side covers 14. Conventionally, a control panel 19, which has a variety of operating switches, and the like, is located on the top cover 17 or front cover 16. Also, a door 164 is installed to the front cover 16. The rear cover 18 is provided with a suction portion 182 for the introduction of outside air and an exhaust hole 184 serving as a final passage for discharging air from the drum 20 to the outside.

The interior space of the drum 20 serves as a drying chamber in which a wet object is dried. Preferably, the drum 20 incorporates therein lifters 22 for lifting the wet object to be dried, thus causing free falling as well as overturning of the object, in order to achieve an increase in the drying efficiency of the object.

Meanwhile, a front supporter 30 is installed between the drum 20 and the front cover 16 of the cabinet 10 and a rear supporter 40 is installed between the drum 20 and the rear cover 18 of the cabinet 10. That is, the drum 20 is rotatably installed between the front supporter 30 and the rear supporter 40. Sealing members (not shown) are installed between each of the front and rear supporters 30 and 40 and the drum 20, to prevent leakage of hot air. In summary, the front supporter 30 and the rear supporter 40 serve not only to close front and rear surfaces of the drum 20 to define the drying chamber, but also to support front and rear ends of the drum 20.

The front supporter 30 has an opening for communicating the drum 20 with the outside of the drying machine. The opening of the front supporter 30 is configured to be selectively opened and closed by the door 164. The front supporter 30 is connected to a lint duct 50 serving as a passage for directing air from the drum 20 to the outside. The lint duct 50 incorporates therein a lint filter 52. One side of the blower unit 60 is connected to the lint duct 50, and the other side of the blower unit 60 is connected to an exhaust duct 80. The exhaust duct 80 communicates with the exhaust hole 184 provided at the rear cover 18. Accordingly, if the blower unit 60 is operated, the air inside the drum 20 is discharged to the outside through the lint duct 50, the exhaust duct 80, and the exhaust hole 184. In this case, impurities, such as lint, and the like, are filtered by the lint filter 52. Conventionally, the blower unit 60 includes a blower 62 and a blower housing 64. In general, the blower 62 is connected to the motor 70 that is used to drive the drum 20, to thereby be operated by the motor 70.

Conventionally, the rear supporter 40 has a venting portion 42 formed with a plurality of vent holes. The venting portion 42 is connected to the hot air supply duct 44. The hot air supply duct 44 communicates with the drum 20 and serves as a passage for supplying hot air into the drum 20. Accordingly, the hot air heater 90 is installed to a predetermined position of the hot air supply duct 44.

Figure 3:
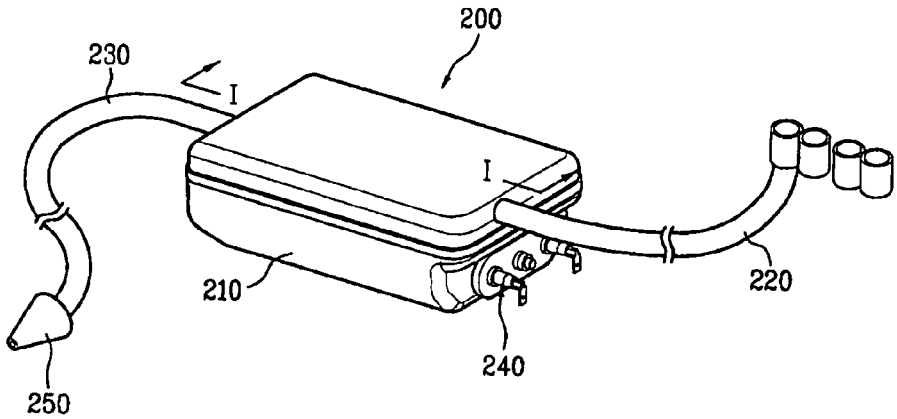
FIG. 3 is a perspective view illustrating a steam generator shown in FIG. 1.
Figure 4:
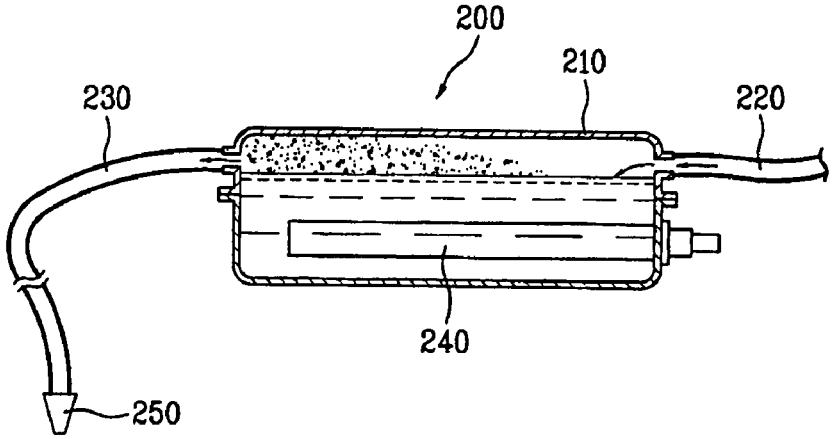
FIG. 4 is a sectional view taken along the line I-I shown in FIG. 3.

The steam generator 200 is installed at a predetermined interior position of the cabinet 10 and adapted to generate steam and supply the steam into the drum 20. Now, the steam generator 200 will be described in detail with reference to FIGS. 3 and 4.

The steam generator 200 includes a water tank 210 for receiving water therein, a heater 240 mounted in the water tank 210, a water supply hose 220 connected to one side of the water tank 210 for supplying water into the water tank 210, and a steam hose 230 connected to the other side of the water tank 210 for discharging steam. Preferably, a nozzle 250 having a predetermined shape is provided at a tip end of the steam hose 230.

Conventionally, one end of the water supply hose 220 is connected to an external water source, such as a water tap. The tip end of the steam hose 230 or the nozzle 250, that is to say, a steam discharge port, is located in the drum 20 at a predetermined position, so that steam is injected into the drum 20.

It will be appreciated by those skilled in the art that the steam generator 200, which is designed to heat a certain amount of water, received in the water tank 210 having a predetermined size, by use of the heater 240 so as to generate steam, is illustrated and described in the present embodiment, but the present invention is not limited thereto. Accordingly, the steam generator may be replaced by any other devices capable of generating steam. For example, the heater may be coupled directly around the water supply hose, through which water passes, so that the water can be heated in the water supply hose rather than being received in a predetermined space.

Meanwhile, in consideration of the fact that the drying machine according to the present invention employs the steam generator 200 for the removal of creases, differently from conventional drying machines, the present invention has a need for supplying water into the drying machine, more particularly, to the steam generator 200. That is to say, the present invention has a need for a water supply device for the drying machine.

Generally, when the drying machine is used at home, there is provided a single water supply source, such as a water tap. Even when cool water and hot water have to be supplied, it can be said that there is provided only one water supply source in view of each of the cool water and the hot water. Furthermore, the drying machine is generally used along with a washing machine, and the washing machine has an essential need for the supply of water. Accordingly, to use the drying machine according to the present invention, that is to say, the drying machine having the steam generator 200, it is preferable that an appropriate water supply device for supplying water to both the drying machine and the washing machine be provided.

Figure 6:
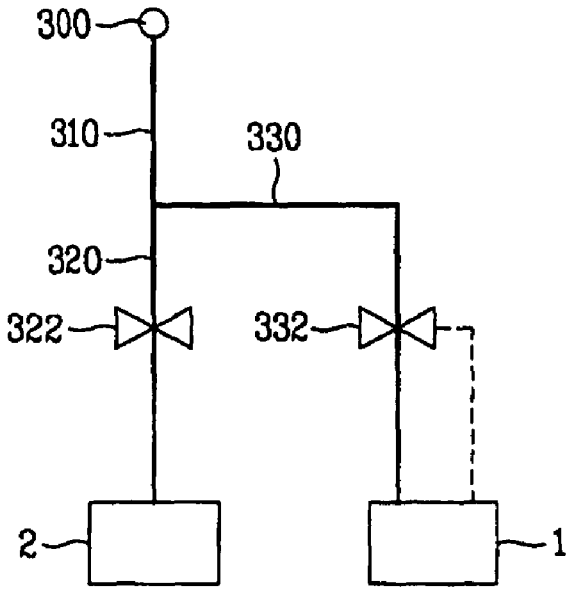
FIG. 6 is a configuration view illustrating a preferred embodiment of a water supply device for a drying machine and a method for controlling the same according to the present invention.

Hereinafter, a water supply device for the drying machine and a method for controlling the same according to the present invention will be described with reference to FIG. 6.

A common hose 310 is connected, at one end thereof, to a water supply source 300 and, at the other end thereof, to a drying machine water supply hose 330 connected to a steam generator of a drying machine 1 and a washing machine water supply hose 320 connected to a washing machine 2. In other words, to supply water into both the washing machine 2 and the drying machine 1, the common hose 310 is branched into the drying machine water supply hose 330 and the washing machine water supply hose 320.

Preferably, at least one of the drying machine water supply hose 330 and the washing machine water supply hose 320 is provided with a valve 322 or 332 for selectively intercepting a flow path. This is because it is conventionally rare that both the drying machine 1 and the washing machine 2 are operated simultaneously. Of course, if necessary, the washing machine valve 322 and the drying machine valve 332 may be opened together, to supply water into both the washing machine 2 and the drying machine 1 simultaneously.

Preferably, the drying machine valve 332 is automatically opened and closed on the basis of the amount of water filled in the steam generator. This is because there is no need for supplying water into the drying machine even during the operation of the steam generator if an appropriate amount of water is filled in the steam generator. This is advantageous, in particular, for a steam generator having a water tank. Although the automatic opening and closing of the drying machine valve 332 may be accomplished in a variety of manners, it is preferable that the drying machine valve 332 be automatically opened and closed on the basis of a water level sensed by a water level sensor that is mounted in the steam generator.

Figure 7:
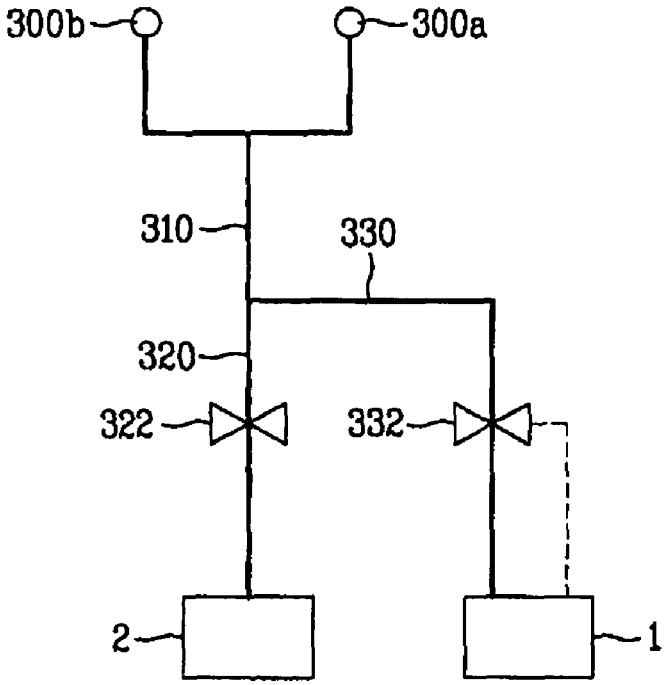
FIG. 7 is a configuration view illustrating another preferred embodiment of a water supply device for a drying machine and a method for controlling the same according to the present invention.

Referring to FIG. 7, in the case where a cool water supply source 300*a* and a hot water supply source 300*b* are provided individually, it is preferable that the common hose 310 is connected to both the cool water supply source 300*a* and the hot water supply source 300*b*. Of course, it will be appreciated that the common hose 310 may be branched into two portions connected, respectively, to the cool water supply source 300*a* and the hot water supply source 300*b*, and the respective branched portions of the common hose 310 may be connected to the drying machine water supply hose 330 and the washing machine water supply hose 320, respectively.

Figure 5:
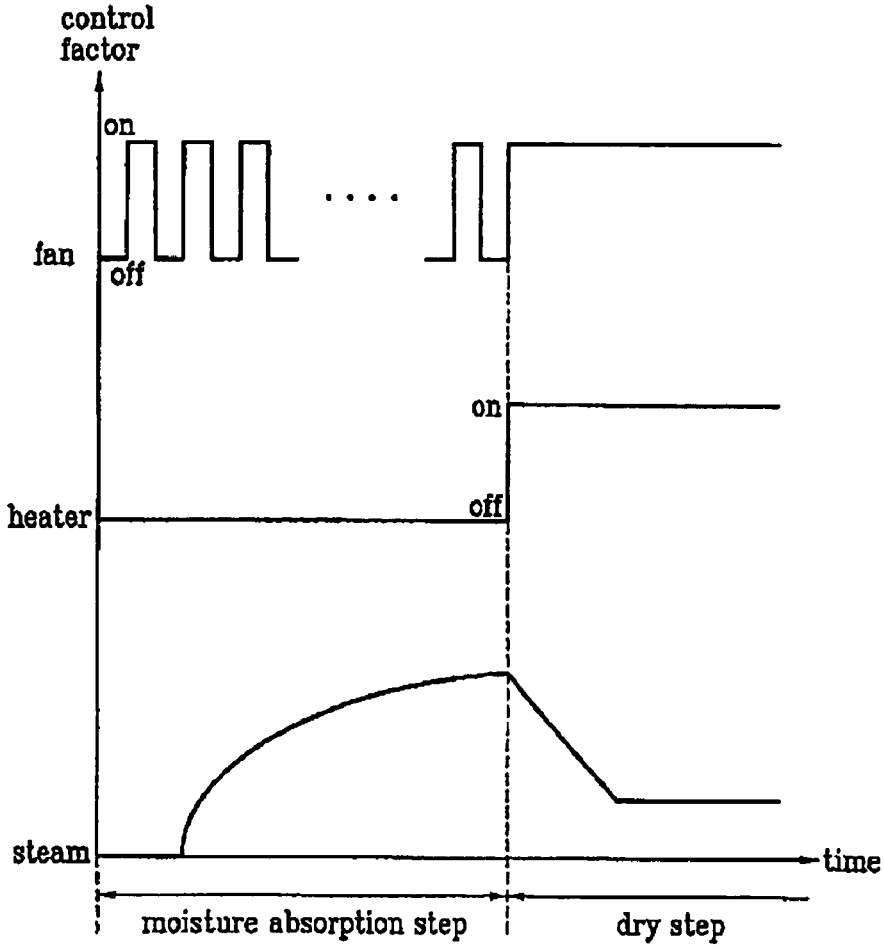
FIG. 5 is a graph illustrating the relationship between control factors in a method for controlling the drying machine according to the present invention.

Now, the drying machine and the method for controlling the same according to the present invention will be described with reference to FIGS. 1, 2 and 5.

The method for controlling the drying machine according to the present invention basically comprises a moisture absorption step and a drying step. That is, differently from conventional drying machines, the control method of the drying machine according to the present invention has a feature in that the moisture absorption step is performed prior to the drying step. The moisture absorption step means a step for swelling an object to be dried via permeation of moisture into the object. The drying step may be equal to or similar to that of conventional drying machines.

Hereinafter, the moisture absorption step and the drying step will be described in detail.

If an object to be dried, for example, which has been completely dehydrated laundry, is input into the drum 20, and then, an operating button of the drying machine is pushed, the drying machine begins a drying operation. As the drying machine operates, the moisture absorption step is first performed. In the moisture absorption step, the steam generator 200 operates. Specifically, the heater 240 of the steam generator 200 operates to heat water and generate steam. The generated steam is injected into the drum 20. Generally, steam is not generated as soon as the heater 240 operates, but generated after the lapse of a certain time. The generation of the amount of steam increases proportional to the lapse of time.

Then, if a sufficient amount of moisture is absorbed into the object to be dried, the operation of the steam generator 200 is stopped. A time required for the moisture absorption step may be changed according to the kind of the drying object, and preferably, may be selected as an appropriate value on the basis of experimental results, and the like. This is because it has been found, from research results provided by inventors of the present invention, that the higher the moisture absorption rate or moisture content rate of the drying object, generally, a more efficient crease removal effect can be accomplished. In this case, it is noted that the drying object has a difference in the absorption degree of moisture according to the kind of constituent fibers thereof even under a constant humidity condition. For example, polyester has a low moisture absorption rate, whereas cotton has a relatively high moisture absorption rate, under a constant humidity condition.

Accordingly, it is preferable that an optimum moisture absorption rate be determined in consideration of the kind of fibers and then, a time of the moisture absorption step suitable for achieving the optimum moisture absorption rate be determined to enable appropriate regulation of the moisture absorption step on the basis of the determined results. Meanwhile, the operating manner of the steam generator 200 in the moisture absorption step is not limited, and may be appropriately controlled to achieve the predetermined moisture absorption rate. In one example, the operation of the steam generator 200 may be started at the beginning of the moisture absorption step, and be stopped at the ending of the moisture absorption step. In another example, the steam generator 200 may be intermittently operated. In yet another example, the optimum moisture absorption rate depending on the kind of the drying object may be determined on the basis of experimental results, and the like, and the moisture absorption step may be ended if it is determined by a moisture sensor provided at the drum 20 that the drying object absorbs a predetermined amount of moisture.

Preferably, the drying object is agitated in the moisture absorption step. This is because appropriately agitating the drying object is efficient to guarantee moisture to be absorbed evenly to the overall drying object. Although there is no limit in an agitating manner of the drying object, it is preferable that the drum 20 be rotated appropriately. In this case, the rotating conditions, such as the revolution per minute, rotating direction, and the like, of the drum 20 are not limited specifically, but be determined appropriately. For example, the drum 20 is preferably adapted to repeat forward and reverse rotations thereof, and more preferably, adapted to be rotated intermittently.

Meanwhile, it is preferable that the hot air heater 90 not be operated in the moisture absorption step, but be operated after completing the moisture absorption step, that is to say, prior to performing the drying step.

In association with the blower 52, it is preferably operated in the moisture absorption step and more preferably, operated intermittently. This is because a part of the steam injected into the drum 20 may be condensed during the moisture absorption step. In this case, by operating the blower 62, condensed water or humid air just prior to being condensed is able to be discharged to the outside of the drum 20. On the basis of the research results provided by the inventors of the present invention, when liquid-phase moisture rather than steam is absorbed into the drying object, the drying object may have an increase of creases. Accordingly, it is preferable that the condensed water be discharged to the outside, in order to prevent the condensed water from being absorbed into the drying object. The above described operating manner of the blower 62 in the moisture absorption step may be suitable, in particular, for use in condensing-type drying machines.

Meanwhile, with the water supply device according to the present invention, water can be efficiently supplied into the steam generator 200 in the moisture absorption step without causing inconvenience to the user.

Next, the drying step is described as follows. In the drying step, the hot air heater 90 and the blower 62 are operated to supply hot air into the drum 20. Thereby, the drying object received in the drum 20 is able to be dried via heat exchange with the hot air. Preferably, the operation of the steam generator 200 is stopped during the drying step. The operation of the drying machine in association with the drying step can be controlled in the same manner as a conventional control method and thus, the detailed description thereof will be omitted.

With experimental results provided by the inventors of the present invention, it can be found that performing the moisture absorption step prior to the drying step can achieve a highly efficient crease removal effect as well as an anti-crease effect although these effects may depend on the kind of the drying object, for example, the kind of cloth, and the absorption degree of moisture.

Although the above described embodiment describes the laundry, which has been completely dehydrated in the washing machine, as one example of the drying object, the present invention is not limited thereto. For example, in the case of clothes worn by the user for approximately a day, that is to say, clothes that were completely dried and have a few number of creases, the drying machine of the present invention has a function of eliminating creases in the clothes. That is to say, the drying machine according to the present invention is usable as a kind of crease removal device.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention provides a drying machine and a method for controlling the same having the following industrial advantages.

Firstly, the present invention has an advantage in that it is possible to efficiently prevent a completely dried object from being creased, or to remove creases in the object. Also, the present invention has an advantage in that it is possible to efficiently remove creases or wrinkles in dried clothes without an ironing operation.

Secondly, with a water supply device for the drying machine, there is an advantage in that an appropriate amount of water can be supplied into the drying machine without causing the user's inconvenience.

The invention claimed is:

1. A pair of laundry machines comprising:

a washing machine having a washing space for washing laundry;

a drying machine having a drying space for drying laundry which is a separate space from the washing space;

a common hose connected to at least one water supply source;

a drying machine water supply hose connecting the common hose to the drying machine for flow communication; and a washing machine water supply hose connecting the common hose to the washing machine for flow communication, wherein the common hose is branched into the drying machine water supply hose and the washing machine water supply hose for supplying water to the drying machine and the washing machine.

2. The pair of laundry machines according to claim 1, wherein the drying machine includes a steam generator and the drying machine water supply hose is connected to the steam generator.

3. The pair of laundry machines according to claim 1, wherein at least one of the drying machine water supply hose and the washing machine water supply hose is provided with a valve.

4. The pair of laundry machines according to claim 3, wherein the valve is provided to the drying machine water supply hose and controlled on a basis of an amount of water in the steam generator.

5. The pair of laundry machines according to claim 4, wherein the steam generator has a water level sensor and the valve is controlled on the basis of a water level sensed by the sensor.

6. The pair of laundry machines according to claim 1, wherein the at least one water supply source is a hot water supply source.

* * * * *